United States Patent [19]

Fletcher

[11] 4,154,402

[45] May 15, 1979

[54] SHOWER HEAD

[76] Inventor: Samuel L. Fletcher, 1521 4th Ave., Greeley, Colo. 80631

[21] Appl. No.: 776,132

[22] Filed: Mar. 10, 1977

[51] Int. Cl.[2] ..... B05B 1/08

[52] U.S. Cl. ..... 239/487; 239/590.3

[58] Field of Search ..... 239/101, 102, 487, 488, 239/590.3

[56] References Cited

U.S. PATENT DOCUMENTS

| | | | |
|---|---|---|---|
| 2,664,312 | 12/1953 | Czarnecki, Jr. et al. | 239/590.3 |
| 3,300,146 | 1/1967 | Oppenheimer | 239/487 |
| 3,726,482 | 4/1973 | Heinrichs | 239/487 X |
| 3,892,363 | 7/1975 | Hilger | 239/101 |
| 4,013,230 | 3/1977 | Gondek | 239/590.3 |
| 4,060,199 | 11/1977 | Brüne et al. | 239/488 |

FOREIGN PATENT DOCUMENTS

| | | | |
|---|---|---|---|
| 2524856 | 1/1976 | Fed. Rep. of Germany | 239/102 |

*Primary Examiner*—John J. Love
*Assistant Examiner*—Andres Kashnikow
*Attorney, Agent, or Firm*—Horace B. Van Valkenburgh; Frank C. Lowe

[57] ABSTRACT

A stem has an upper central bore terminating a short distance from the lower end, with transverse holes for connecting the bore with the outside of the stem. Below these holes is a spiral rib, such as an Acme thread, with the lower end of the stem being beveled. A housing having interfitting threads with the stem and adjustable along the stem has a central bore terminating in a conical surface corresponding to the bevel of the stem, from which a hole extends to the lower end of the housing. A restricted hole in a passage leading to the stem, as in the ball of a ball joint, restricts flow through the head to on the order of 2 to 1.6 gallons per minute, for certain sizes of holes tested. A pair of opposed holes, spaced equidistantly from the bottom of the stem, extend through the rib area into a short counterbore at the lower end of the stem, and result in the production, at certain longitudinal positions of the housing relative to the stem, of pulsating, oscillating jets having a massage effect. These holes may be positioned at different places relative to the rib and to the channel between turns of the rib.

11 Claims, 12 Drawing Figures

SHOWER HEAD

This invention relates to shower heads.

A shower head of this invention primarily produces a marked reduction in water usage. Also, the shower head may be made adjustable to produce a fine spray, or a heavier spray, as well as pulses of spray jets adapted to produce a massaging effect.

Many pulsating shower heads on the market consume an undue amount of water, as on the order of 5 to 7 gallons per minute. A shower head which does not produce pulsations, but is economical with respect to the heads described above, has a hollow stem which extends into a housing with a bore and a discharge hole smaller than the bore. The hollow stem is imperforate at the lower end, and four lateral holes are provided for discharging the water inside the housing. The beveled end of the stem is provided with four milled slots spaced equidistantly apart and the inside end of the housing bore is also correspondingly beveled. This shower head reduces the consumption of water to approximately 4½ gallons per minute, while appropriate rotation of the housing changes the spray from a pencil-like jet to a cone, but no pulsations are produced. Shower spray heads of U.S. Pat. Nos. 3,563,462, 3,741,481 and 3,770,200 are stated to produce pulsations, but involve complicated passages formed in opposed flat blocks, relying on air entrainment in a shift of flow to different passages.

Among the objects of the present invention are to provide a shower head which will consume less water than preceding shower heads; to provide such a shower head which will produce a variety of water sprays, including cones of different angularity and intensity, as well as pulsating and oscillating sprays which produce a massaging effect; and to provide such a shower head which may be readily produced and is efficient and effective in use.

The fulfillment of the foregoing and other objects will become apparent from the description which follows, taken in conjunction with the accompanying drawings, in which.

Figure 1:
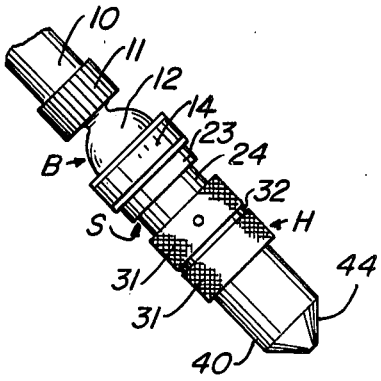
FIG. 1 is a side elevation of a shower head of this invention mounted on a water pipe.
Figure 2:
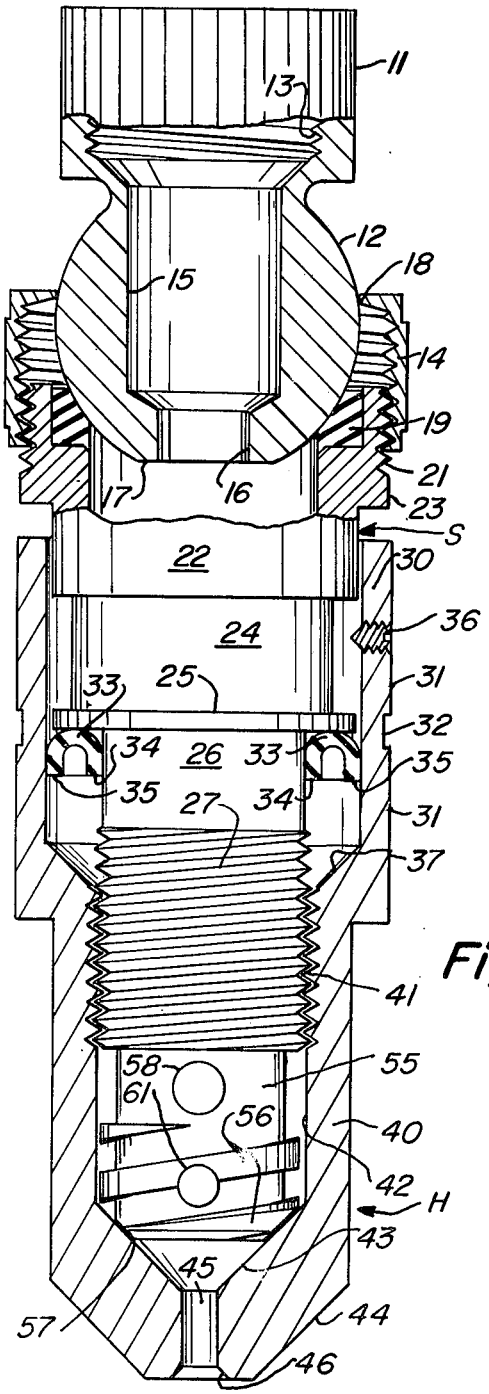
FIG. 2 is a side elevation, on an enlarged scale, of the operative parts of the shower head of FIG. 1, with a housing and a portion of a connection being shown in section to show the interior construction thereof.
Figure 3:
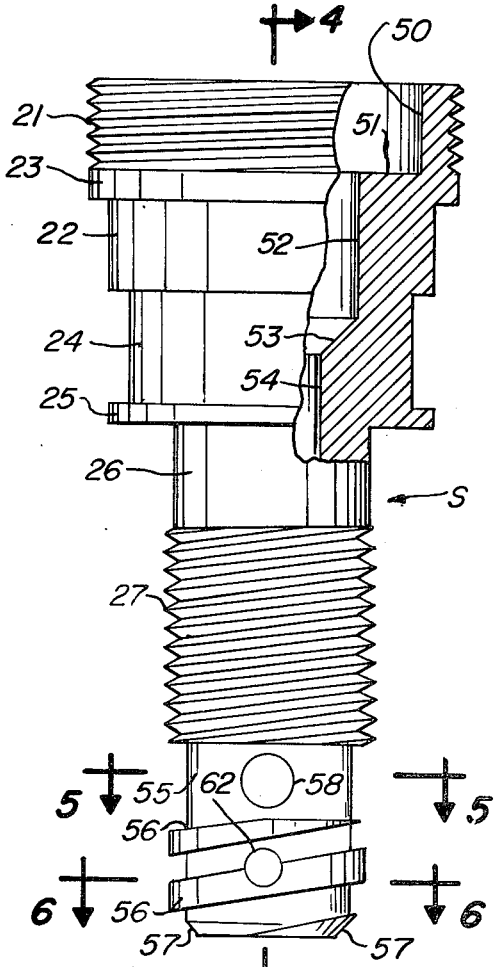
FIG. 3 is a side elevation of a stem forming a part of the construction shown in FIG. 2, but showing the opposite side of the stem from that shown in FIG. 2 and partially broken away to show the interior construction.

As illustrated in FIGS. 1–3, the shower head of the present invention may include a stem S which extends into a housing H and, at its inner end, is connected by a ball joint B to a shower pipe 10 from which flows water of the desired temperature, as through admixture of hot and cold water by a valve or valves of conventional construction. The ball connection B includes a pipe socket 11 which is integral with a conventional open ended ball 12, the pipe socket being provided with interior threads 13 to engage corresponding threads on the end of pipe 10. A ring 14 of the ball connection is provided with interior threads, for attachment of the stem S thereto. The ball 12 is provided with a bore 15, which may continue through the ball or connect with a smaller bore 16 which continues to the flat lower end 17 of the ball. An angular lip 18, at the upper inner edge of ring 14, clamps the spherical surface of the ball, to hold the ball compressed against a seal ring 19 held against the inside of stem S but permits the stem and housing to pivot about the ball, so that the shower head may be adjusted to different angular positions, both vertically and horizontally, so as to direct the spray at a desired point or region. The upper end of stem S is provided with threads 21 for engaging the threads of ring 14, while below threads 21, a cylindrical surface 22 is adjacent a shoulder 23. A cylindrical surface 24 of reduced diameter may extend from surface 22 to a flange 25, which has a diameter essentially that of the surface 22 and which may be used as a stop, in a manner described below. Below flange 25 is a cylindrical surface 26 of still further reduced diameter, which extends to a set of external threads 27 through which the housing H may be adjusted upwardly and downwardly along the stem S.

Figure 8:
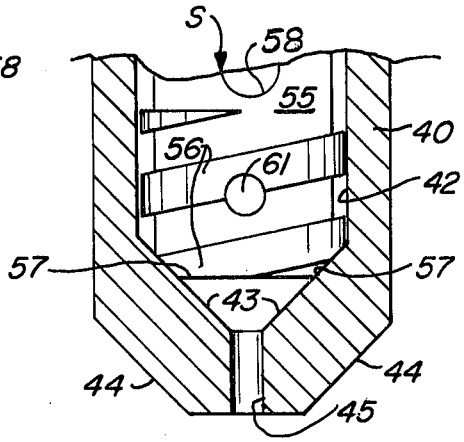
FIG. 8 is a fragmentary view similar to a lower portion of FIG. 2, showing the lower end of the stem abutting the inside of the housing.

The housing H is provided with a socket 30 which surrounds the surfaces 22, 24, 26 and flange 25 of the stem. Preferably, to prevent any side to side movement of the housing, the clearance between the outside of flange 25 and the inside of socket 30 should be on the order of 0.003 to 0.005 inches. The outer surface 31 of the socket, as in FIG. 1, is preferably knurled to facilitate the grasp of the user thereon, in adjusting the shower to a desired spray condition. The knurling of the surface 31 may be broken by a central groove 32, to reduce the width necessary for the knurling tool. A circular seal ring 33, having an inverted U-shape with an inside leg 34 and an outside leg 35, may abut the underside of flange 25. A set screw 36 may be placed at an appropriate position in socket 30, to abut flange 25 when the housing H moves a predetermined distance downwardly, such as three full turns from the initial abutting position shown. It will be noted that set screw 36 also prevents the user from, perhaps unintentionally, unthreading the housing completely off the stem. In the position of FIG. 8, the lower end of the stem S abuts the lower inside bevel of the housing H, which acts as a stop to limit upward movement of the housing on the stem.

A bevel 37, as shown, may connect the inside of socket 30 with the inside of a lower tubular wall 40, having a lesser diameter than the socket, while the upper portion of the tubular wall 40 is provided with threads 41, which engage the threads 27 of the stem. When the stem and housing are assembled, the seal ring 33 may be inserted within the housing H prior to insertion of the stem S therein, at the area of the bevel 39. As soon as the shower is turned on and water can flow upwardly along the threads 27 and 41, the pressure of water will normally move the seal up to a position abutting flange 25, as shown. The seal ring 33 particularly seals off any water which may flow back along the threads 27 and 41, when the shower head is in use. It will be noted that the U-shape of the seal 33 produces pressure against both the surface 26 and the inside of socket 30, by the pressure of water exerted within the seal. A smooth bore 42 is below the threads 41 and terminates in an inverted conical surface 43. At the lower end of the outside of housing H is an inverted conical surface 44 and a central discharge hole 45 which extends to the hollow inside of the housing, with a bevel 46 being formed, if desired, at the lower end of hole 45.

Figure 4:
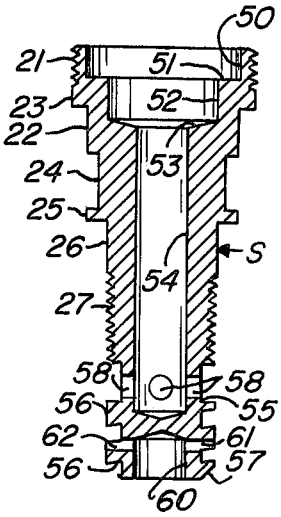
FIG. 4 is a longitudinal section of the stem of FIG. 3, on a reduced scale, and taken along line 4—4 of FIG. 3.
Figure 10:
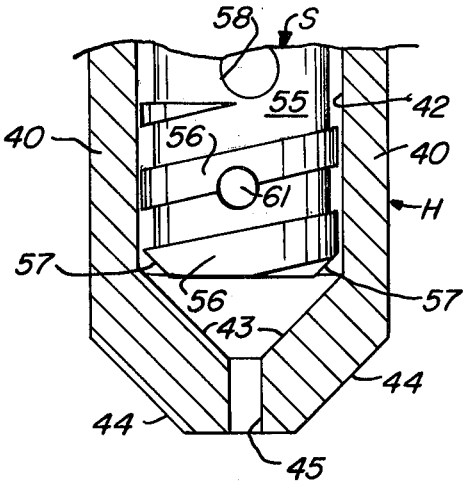
FIG. 10 is a view corresponding to FIG. 8, but showing the housing threaded downwardly on the stem by one full turn.
Figure 11:
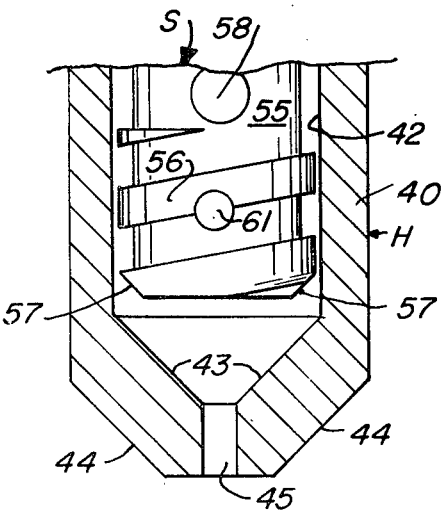
FIG. 11 is a view similar to FIG. 10, but showing the housing threaded downwardly still another turn.
Figure 12:
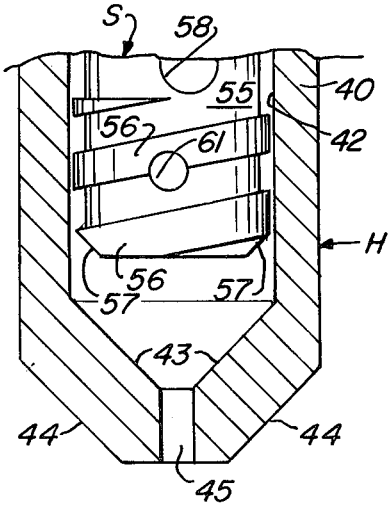
FIG. 12 is a view similar to FIG. 10, but showing the housing threaded downwardly still another turn.

Inside stem S, as in FIGS. 3 and 4, a well 50 extends inside threads 21 to a shoulder 51, with a well 52 of lesser diameter extending downwardly to a bevel 53, below which extends a bore 54 which terminates within the stem. On the outside, below threads 27 is a cylindrical surface 55 from which extends an outstanding spiral rib 56, such as an Acme thread, which may extend upwardly from the lower end of the stem, as at a bevel 57, for between two and three turns around the outside of the stem, with two and one-half turns being preferred. Above the spiral rib 56 is a series of holes 58, such as four in number, which extend into the bore 54, as in FIG. 4, and transfer the flow of water from the inside to the outside of the stem. In the position of FIG. 8, the bevel 57 at the lower end of the stem abuts bevel 43 in the housing to prevent, to a large extent, any flow through the lower bore 45 of the housing. However, if the housing is unscrewed from the stem, as to or toward a position corresponding to FIGS. 10, 11 or 12, the flow through holes 58 will flow along the channel between the turns of rib 56, to issue from hole 45 of the housing as a cone-shaped spray, which will tend to be finer and narrower with the housing a short distance only from the abutting position of FIG. 8, but harder and wider at other positions. The construction as described to this point may be used as a shower head with a low water consumption, but without pulsation.

A shower head of this invention has been tested with a bore hole 16 of the ball 12 having a diameter of ¼ inch and the flow tested at 2.0 gallons per minute, with water pressure measured at 80 pounds per square inch. However, with a bore 16 of 9/64 inches in diameter, the flow, as similarly tested, was reduced to 1.8 gallons per minute; for a diameter of the bore 16 of 7/64 inches, the flow, as similarly tested, was reduced to 1.6 gallons per minute; and for a diameter of the bore 16 of 3/32 inches, the flow, as similarly tested, was reduced to 1.5 gallons per minute. This flow was independent of the additional features which produced the pulsating, oscillating flow.

For pulsating, oscillating spray jets, a central counterbore 60 extends upwardly into the stem from the lower end, with the upper end of the counterbore being spaced from the lower end of bore 54. In order to return at least part of the flow to the inside, i.e. into the counterbore 60, a pair of auxiliary holes coact with spiral rib 56, with each set of holes being oppositely disposed, at the same distance from the lower end of the stem. In one instance, as in FIG. 2, the centerline of a hole 61 is approximately on the edge of the spiral rib 56 above it, while the centerline of the opposite hole 62, as in FIG. 3 is approximately on the upper edge of the spiral rib below it. Thus, one half of each hole occupies a portion of the channel between two adjacent spirals of the rib, with the remaining half occupying a portion of the adjacent rib, but the holes are the same distance from the lower end of the stem. In order to insure the production of pulsating, oscillating spray jets in at least one position of the stem relative to the housing, the clearance between the outside of thread or rib 56 and the inside of bore 42 of the housing should be on the order of 0.010 to 0.015 inches, i.e. the difference between the outside diameter of rib 56 and the inside diameter of bore 42 should be 0.030 inches or less, assuming they are concentric.

Figure 7:
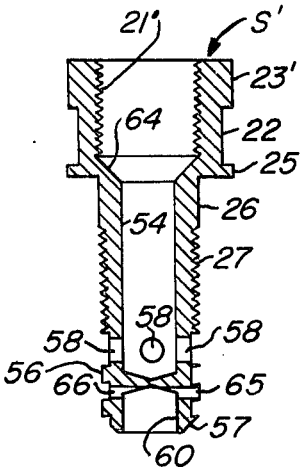
FIG. 7 is a longitudinal section of a stem of an alternative embodiment of this invention.
Figure 5:
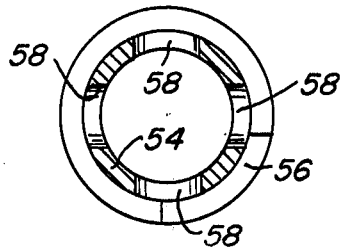
FIG. 5 is a cross section taken along line 5—5 of FIG. 3.
Figure 6:
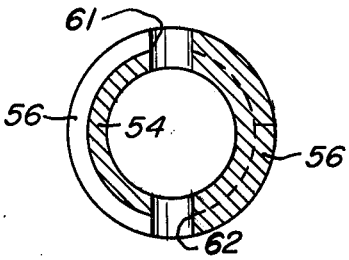
FIG. 6 is a cross section taken along line 6—6 of FIG. 3.
Figure 9:
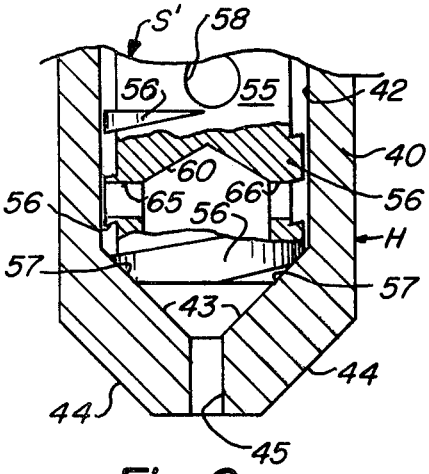
FIG. 9 is a view similar to FIG. 8, but showing the stem of FIG. 7, which is partially broken away to show the interior construction.

The stem S′ of FIGS. 7 and 9 differs from stem S, at its upper end, in the provision of inside threads 21′, so that the stem, along with the housing H, may be installed directly on the water pipe 10, when desired. On the outside, as before, the stem S′ is provided with a shoulder 23′, above a cylindrical surface 22, below which is a flange 25. Below the latter, is a reduced cylindrical surface 26, below which are outside threads 27, with a cylindrical surface 55 below the latter. On the inside, a bevel 64 connects the threads 21′ with bore 54, the lower end of which is again spaced from the upper end of counterbore 60. In the cylindrical surface 55, as before, are the series of holes 58 which extend into the bore 54 of the stem, while below holes 58, as before, is the spiral rib 56, conveniently a square thread known as the Acme thread, which extends outwardly from the surface 55, with a small clearance, as before between the outside of rib 56 and the inside bore 42 of the housing H, as on the order of 0.010 inches to 0.015 inches. As before, a bevel 57 is at the lower end of the stem. As will be evident, due to the space between bore 54 and counterbore 60, the water which passes through the stem is discharged, through holes 58, to a position outside the stem and within the housing H. In this respect, the stems S and S′ are the same.

In the stem S′, as in FIGS. 7 and 9, there are holes 65 and 66, opposed as before and spaced equidistantly from the lower end of the stem, but one hole 65 is disposed centrally of a turn of the spiral rib 56 and the opposite hole 66 occupies a central position in the channel between turns of the rib. Apparently, in each of the stems S and S′, the opposite location of the holes and equidistant spacing from the lower end of the stem is necessary to achieve the pulsation and oscillation of the spray jets which produces a massage effect. However, with either set of holes, the same amount of water consumed by the shower head is achieved, as in the tests set forth above. The slightly varying locations of the holes 61 and 75, for instance, as shown in FIGS. 8 and 9, are actually variations in the circumferential positions of the holes, rather than the spacing of the holes from the lower end of the stem. Thus, the centerlines of holes 61, 62 and 65,66 may be spaced 3/16 inch from the lower end of a stem having a spiral rib whose outer diameter is approximately 0.675 inch, and the holes may have a diameter of 0.125 inch. The holes 58 are preferably slightly greater in diameter, such as approximately 7/32 inch. The holes 65 and 66 of stem S′ may be drilled either before or after the milling or machining of the spiral rib 56, but it should be more convenient to drill holes 61 and 62 before milling or machining.

As indicated previously, the stem S is shown in FIG. 8 and the stem S′ is shown in FIG. 9 with the bevel 57 abutting the lower conical end 43 of the bore 42 of the respective housing H. In each of these positions, it will be noted that there is still a flow of water through the discharge hole 45 of the housing. This is due to the passage of water down the channel between the turns of the rib of each stem, with water flowing from the outside into the counterbore 60 of the stem through each of the holes 61 and 62 for the stem S and for the stem S' through the hole 66 which extends into the channel between two turns of the rib. There may also be a slight flow through the hole 65, by leakage of water between the outer surface of the corresponding turn of the rib 56 and the inside wall of housing bore 42, but this is maintained at a minimum, as indicated previously. In the case of the stem S, in the abutting position of FIG. 8, the spray is a narrow conical spray of jets, sometimes pulsating; in the case of stem S', in the abutting position of FIG. 9, the spray is also a narrow conical spray of jets, usually finer and not pulsating. However, when the housing H is turned a short distance toward the position of FIG. 10, on either stem S or stem S', a pulsation and oscillation of the jets for a massage effect has normally been produced, with a widening of the cone of the spray, although the location of this position has sometimes varied. Also, when the housing is turned almost one full turn, i.e. to or slightly before the position of FIG. 10 for either stem, stronger jets, pulsating and oscillating, have been produced, with a stronger massage effect. Between the position of FIG. 10 to the position of FIG. 11, i.e. an additional turn of the housing, or further to the position of FIG. 12, a still further turn, some of the heads tested have produced pulsating, oscillating jets at one or more additional positions. For other heads and stems tested, the production has been essentially similar wider conical sprays of slightly harder jets, without pulsations or oscillations, between a few degrees beyond the position of FIG. 10 to the position of FIG. 12. Thus, if desired, for such stems, the flange 25 could be placed so that set screw 36 would prevent rotation of the housing on the stem further than a short distance beyond the position of FIG. 10.

The exact reason for the pulsations and oscillations being produced is not conclusively known, although it may be due to an interference pattern between the water moving around the channel between turns of the rib to be discharged in circular fashion against the conical surface 43 of the housing and the stream passing from the outside of the stem to the counterbore 60, through the holes 61, 62, or 65, 66.

The stem S' may be used with a restrictive flow disc having a hole corresponding to hole 16 of ball 12 of stem S, or the bore 54 may be correspondingly reduced in diameter. It has also been found that the holes 61, 62 or 65, 66 need not be 180° apart, but instead may be placed at other positions, such as 90° apart.

Although a preferred embodiment of this invention and certain variations therein have been illustrated and described, it will be evident that other embodiments may exist and that other changes may be made, all without departing from the spirit and scope of this invention.

What is claimed is:

1. A shower head comprising:

a stem having an inlet at the upper end and a bore extending from said inlet toward but spaced from the lower end;

a housing surrounding the lower portion of said stem and adjustable along said stem, said housing having a restricted outlet at its lower end and said stem having a spiral outward rib extending upwardly from the lower end thereof;

said stem having a series of holes connected with said stem bore and disposed above said spiral rib, for flow of water from the inside of said stem to the outside of said stem and between the turns of said rib to said outlet;

said stem having a counterbore extending from the lower end toward said first bore;

said first bore and counterbore being spaced apart longitudinally and the longitudinal extension of said counterbore being less than the longitudinal extension of said first bore; and said stem having at least one second hole extending inwardly to said counterbore and within the longitudinal area of said rib and constructed and arranged to transfer to said counterbore a portion of the water flowing between the turns of said rib.

2. A shower head as defined in claim 1, wherein:

said spiral rib has a cross section corresponding to that of a square thread.

3. A shower head as defined in claim 2, wherein:

said clearance between the outer surface of a spiral rib and the inside of said bore of the housing is on the order of 0.010 inches to 0.015 inches.

4. A shower head as defined in claim 2, wherein:

said housing has a bore accommodating said stem and is provided with an inside, inverted conical surface leading from said bore to said restricted outlet.

5. A shower head as defined in claim 4, wherein:

the lower end of said stem is provided with a bevel corresponding in angularity to said inverted conical surface inside said housing.

6. A shower head as defined in claim 5, wherein:

said head has a restricted hole leading to said bore of said stem.

7. A shower head as defined in claim 6, wherein:

said restricted hole is located in a ball of a ball joint connection for said stem.

8. A shower head as defined in claim 1, wherein:

said second hole comprises one of two opposed holes spaced equidistantly from the lower end of said stem.

9. A shower head as defined in claim 8, wherein:

said second holes each extend through a portion of said rib and a portion of an adjacent channel between the turns of said rib.

10. A shower head as defined in claim 8, wherein:

a clearance is provided between the outer surface of said spiral rib and the inside of said housing bore; and the outer terminus of one of said second holes is within the channel between two turns of said rib and that of the other of said second holes is located within a turn of said rib.

11. A shower head as defined in claim 1, wherein:

said housing has a bore accommodating said stem and is provided with an inside, inverted conical surface leading from said bore to said restricted outlet; and the lower end of said stem is provided with a bevel corresponding in angularity to said inverter conical surface inside said housing.

* * * * *